United States Patent [19]

Hemmer

[11] Patent Number: 4,583,290

[45] Date of Patent: Apr. 22, 1986

[54] METHOD FOR MAKING CONTACT ASSEMBLY FOR AN ELECTRICAL CONNECTOR

[75] Inventor: Valentine J. Hemmer, Sidney, N.Y.

[73] Assignee: Allied Corp., Morristown, N.J.

[21] Appl. No.: 677,266

[22] Filed: Dec. 3, 1984

Related U.S. Application Data

[62] Division of Ser. No. 499,689, May 31, 1983, abandoned.

[51] Int. Cl.[4] ..... H07K 43/16

[52] U.S. Cl. ..... 29/874; 339/276 T

[58] Field of Search ..... 29/874, 876, 862; 339/276 T, 258 R

[56] References Cited

U.S. PATENT DOCUMENTS

| | | | |
|---|---|---|---|
| 4,136,923 | 1/1979 | Spaulding | 339/276 T X |
| 4,184,735 | 1/1980 | Spaulding | 339/276 T X |
| 4,373,773 | 2/1983 | Piscitelli et al. | 339/276 T X |
| 4,381,135 | 4/1983 | Hemmer et al. | 29/876 X |

*Primary Examiner*—Howard N. Goldberg
*Assistant Examiner*—Carl J. Arbes
*Attorney, Agent, or Firm*—C. D. Lacina

[57] ABSTRACT

The invention is a three-piece contact assembly for an electrical connector. The contact assembly is characterized by an inner sleeve (10) captivated between a forward outer sleeve (20) and a rear outer sleeve (30) to eliminate deformation and relative movement between the sleeves of a contact assembly.

3 Claims, 24 Drawing Figures

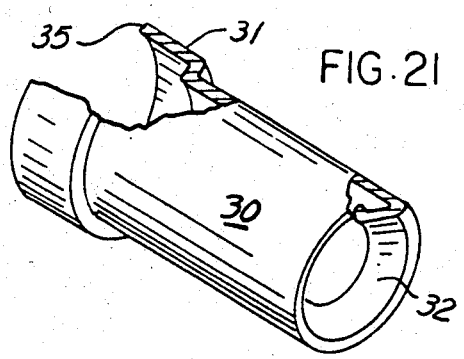
FIG. 21
FIG. 22
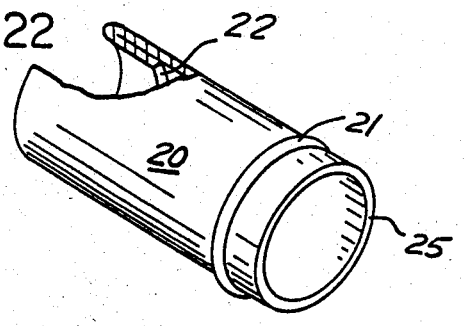
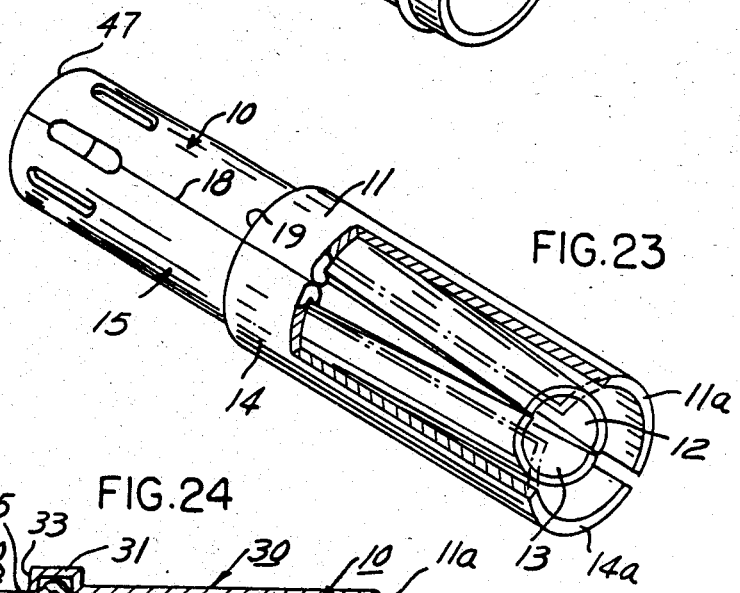
FIG. 23
FIG. 24
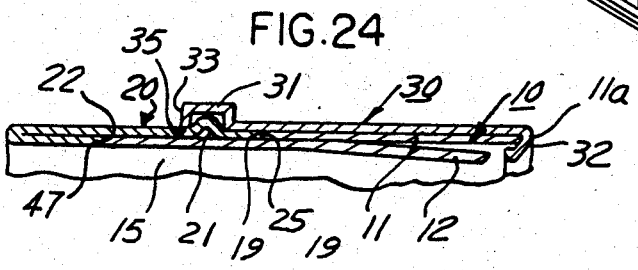

METHOD FOR MAKING CONTACT ASSEMBLY FOR AN ELECTRICAL CONNECTOR

This application is a division of Ser. No. 499,689, filed May 31, 1983, now abandoned.

This invention relates to electrical connectors and more specifically to three piece socket type electrical contacts mounted within the electrical connector.

Electrical connectors generally include a plug and receptacle each having an insert of dielectric material provided with a plurality of axially extending passages within which electrical contacts are retained. In most instances the contacts are pin and socket type contacts that are machined from a single solid piece of metal or stamped and formed from a thin sheet of metal to reduce the cost and weight of the contact. One example of a stamped and formed contact may be found in U.S. Pat. No. 4,120,556 entitled "Electrical Contact Assembly", issued Oct. 17, 1978. A stamped and formed contact assembly is generally comprised of three sleeves. The sleeves are connected together by a friction fit or a crimp or punch between the sleeves to mechanically attach them together. However, crimping or punching while providing a good mechanical and electrical connection between the sleeves often causes deformation of the sleeves so that they are no longer round and therefore do not meet the requirements of certain customers' specifications. Where the sleeves of the contact assembly are friction fit together, the problem of relative movement between the sleeves of a contact occurs upon mating of the contacts. Another example of a contact assembly having these problems is disclosed in U.S. Pat. No. 4,136,923 entitled "Unitary Hooded Electrical Contact", issued Jan. 30, 1979. The contact assembly in the U.S. Pat. No. 4,136,923 does not provide an abutment for securing an outer sleeve around the hooded inner sleeve and the outer sleeve would have to be friction fit or crimped to the hooded contact which results in the aforementioned problems.

DISCLOSURE OF THE INVENTION

This invention eliminates friction fitting or crimping together the sleeves of a contact assembly. The invention is a three-piece contact assembly characterized by the fact that the inner sleeve is captivated between a forward outer sleeve and rear outer sleeve which are mechanically linked together.

Accordingly, it is an advantage of this invention to eliminate deformation of and relative movement between the sleeves of a contact assembly.

It is also an advantage of this invention to eliminate the need for crimping together the sleeves of a contact assembly.

DETAILED DESCRIPTION OF THE INVENTION

FIGS. 21 and 22 illustrate a pair of sleeves which mount to the periphery of the inner sleeve.

FIG. 24 shows a three piece contact assembly including the inner sleeve and the two outer sleeves.

Figure 1:
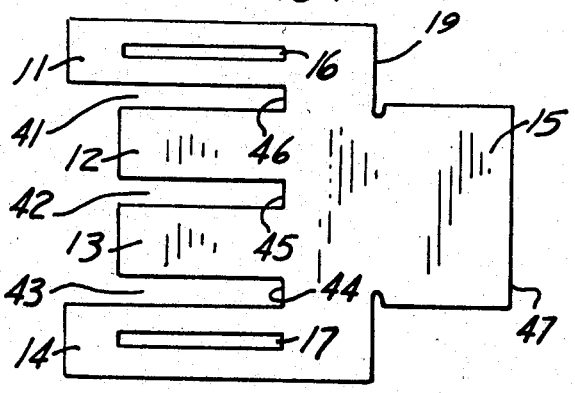

Referring now to the drawings, FIG. 1 illustrates the first step in forming the contact from a flat piece of metal such as beryllium copper about 0.0127 centimeters (0.005 inches) thick. The first step comprises forming the flat sheet such that the sheet has four forwardly extending fingers 11, 12, 13, and 14 and a rear portion 15 having a lateral edge 47. The outer fingers 11 and 14 may include a slot 16 and 17. The forward portion of the sheet includes a forward lateral edge having four slots 41, 42, 43, which extend longitudinally rearward therefrom to their respective terminii 46, 45, 44, and a rearward lateral edge 19, the fingers being laterally spaced by a respective longitudinal web portion that extends between the rearward lateral edge 19 and each respective slot terminus.

Figure 2:
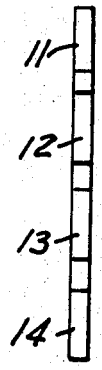
FIGS. 1–3 illustrate the first step in forming an inner sleeve from a flat sheet of metal.
Figure 3:
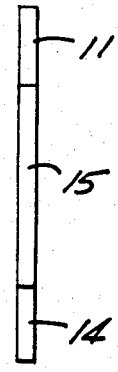

FIGS. 2 and 3 show front end and rear end view of the sheet shown in FIG. 1.

Figure 5:
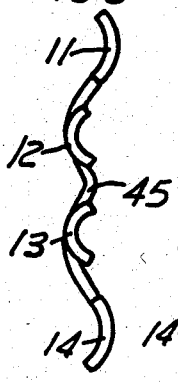
FIGS. 4–6 illustrate the second step in forming the sheet into the sleeve.
Figure 4:
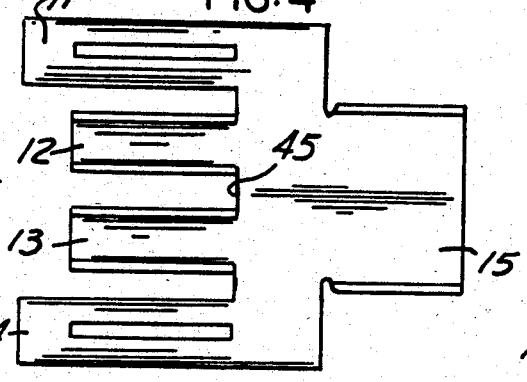
Figure 6:
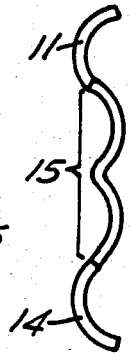

FIGS. 4, 5 and 6 illustrate how the fingers 11 and 14 are bent to be concave and fingers 12 and 13 are bent to be convexed relative to fingers 11 and 14. FIG. 6 illustrates how the rear portion 15 is formed into two convex sections.

Figure 8:
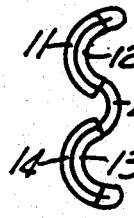
FIGS. 7–8 illustrate the third step in forming the sheet into the sleeve.
Figure 7:
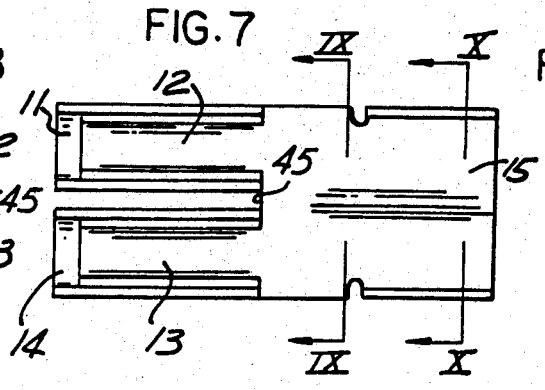
Figure 9:
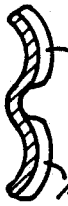
FIGS. 9 and 10 are taken along lines IX—IX and X—X, respectively, of the sheet formed in FIG. 7.
Figure 10:
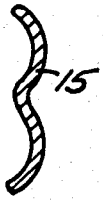

FIGS. 7, 8, 9 and 10 illustrate the next step in the formation of an inner sleeve for contact assembly. As can be seen in FIGS. 7 and 8 the outer fingers 11 and 14 are formed around fingers 12 and 13. FIGS. 9 and 10 show that the rear portion 15 matches the cross-section of the outer fingers 11 and 14.

Figure 12:
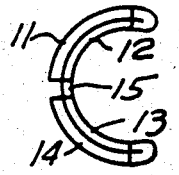
FIGS. 11–13 illustrate the fourth step in forming the sheet into the sleeve.
Figure 11:
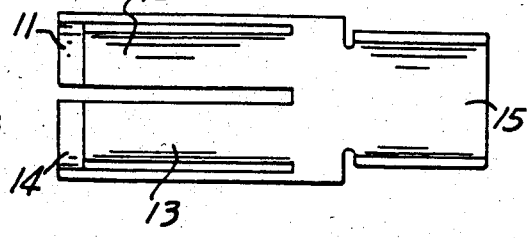
Figure 13:
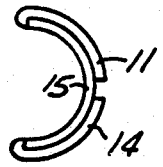

FIGS. 11, 12 and 13 illustrate a partially formed sleeve. FIGS. 11 and 12 illustrate how fingers 11 and 12 have been formed in relationship to fingers 13 and 14 to form a "C" shape or half of a sleeve. FIG. 13 illustrates the configuration of the outer fingers 11 and 14 in relation to the rear portion 15 of the partially formed sleeve.

Figure 15:
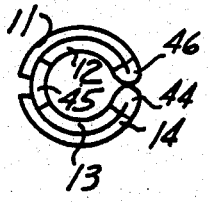
FIGS. 14–16 illustrate the fifth step in forming the sheet into the sleeve wherein a seam is formed by edges being adjoined.
Figure 14:
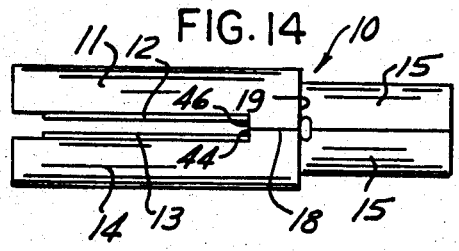
Figure 16:
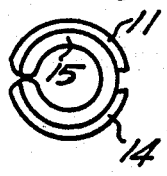

FIGS. 14, 15 and 16 illustrate a completely formed sleeve having an axial seam 18 and internal fingers 12 and 13 surrounded by fingers 11 and 14 which form a hood or protection for the inner fingers 12 and 13. The rear end of the hood includes a rearwardly facing shoulder 19.

Figure 17:
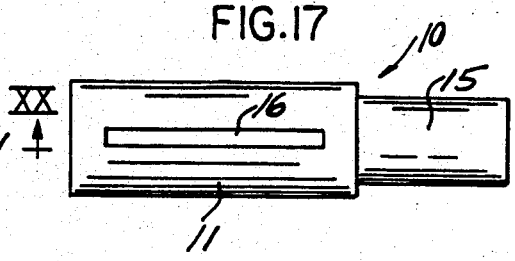

FIG. 17 illustrates the sleeve shown in FIG. 14 rotated 90° to show the slot 16 and the sleeve 10.

Figure 18:
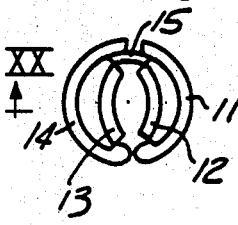
FIGS. 17–19 illustrates the sleeve shown in FIG. 14 but rotated 90 degreees whereby in FIG. 17 to show a slot and pin contacting fingers extending radially inward.
Figure 19:
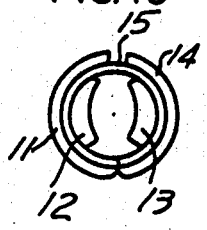

FIGS. 18 and 19 illustrate relationship of the fingers 12 and 13 to the protective hood 11 and 14 and the rear portion 15 of the sleeve 10. The inner fingers 12 and 13 have been deflected inwardly so that their initial position extends the fingers 12 and 13 radially inwardly towards the forward end of the sleeve 10. This was accomplished by utilizing an appropriate tool through this slot in the hood.

Figure 20:
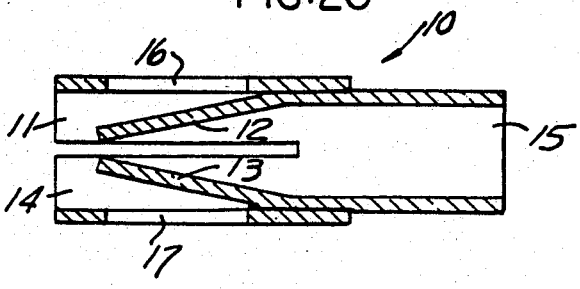
FIG. 20 is a cut-away view taken along lines XX—XX of the sleeve shown in FIG. 18.

FIG. 20 is a cutaway view of the sleeve shown in FIGS. 17–19 and illustrates how the fingers 12 and 13 extend radially inwardly within the sleeve 10.

FIGS. 21 and 22 illustrate a rear or first outer sleeve 20 and a forward or second outer sleeve 30 that is to be located on the inner sleeve 10. The first outer sleeve 20 includes a radial projection 21 in the form of an annular boss around the outside surface thereof, a forward end that terminates in a forwardly facing shoulder 25, and an inwardly turned portion that terminates in a forwardly facing shoulder 22. The second outer sleeve 30 includes an enlarged portion 31 that forms an end face 35 and in the forward portion thereof an inwardly extending forward end 32 that forms a rearwardly facing shoulder.

FIG. 23 illustrates a partial cutaway view of the inner sleeve 10. The inner sleeve 10 includes a hood portion 11 and 14 that terminates at one end and a rearwardly facing shoulder 19 and at the forward end in forwardly facing shoulders 11*a* and 14*a*. The rear portion preferably has a plurality of slots therein.

FIG. 24 illustrates how the first outer sleeve 20 and second outer sleeve 30 are mounted coaxially around the inner sleeve 10 to captivate the inner sleeve 10 within th outer sleeve 20 and 30. The hood portion 11 and 14 of the inner sleeve 10 is captivated between the inwardly extending portion 32 of the second outer sleeve 30 and the forwardly facing end 25 of the first outer sleeve 20. The first outer sleeve 20 and second outer sleeve 30 are connected together by the enlarged portion 31 at the rear end of the second outer sleeve 30 that is formed with a rearwardly facing shoulder 33 so that enlarged portion 31 is around the annular projection 21 on the first sleeve 20.

Having described the invention what is claimed is:

1. A method of making an inner sleeve for a three-piece contact assembly said sleeve having a forward mating portion and a rearward wire receiving portion, the steps of the method comprising:

providing a metal sheet with a pair of generally rectangular and longitudinally extending sheet portions, said sheet having a top and bottom surface, one and the other said sheet portions defining respectively, a pair of longitudinal edges, and said one sheet portion further including a forward lateral edge and three laterally separated slots each extending longitudinally rearward from the lateral edge whereby to define a first, second, third and fourth finger with each adjacent pair of fingers being joined by a longitudinal web portion, laterally folding the one sheet portion so that the first and second fingers and the third and the fourth fingers are confronting, forming the one sheet portion into a cylindrical sleeve portion wherein one respective finger of each said first and second fingers and said third and fourth fingers is disposed radially inward of said sleeve portion, and inwardly bending the free end of each radially inward finger whereby to radially separate the free ends of the two inward fingers from the respective free ends of the two outer fingers.

2. The method as recited in claim 1 wherein the laterally folding step includes overlapping the first and the fourth fingers, respectively, over and onto the bottom surface of the sheet whereby a first web and a third web portion associated, respectively, with the first and second fingers and the third and fourth fingers define a pair of longitudinal edge surfaces.

3. The method as recited in claim 2, wherein the folding step includes working the one sheet so that the first and the fourth fingers and the second and third fingers, respectively, are concave and convex relative to the bottom surface of the sheet, and folding the concave first and fourth fingers laterally over and onto the convex second and third fingers, respectively, whereby to form a cross-section including two pairs of overlapped convex fingers which are interconnected by the intermediate of the three web portions, and the forming step includes progressively bending the two pairs of overlapped convex fingers towards one another until the longitudinal edge surfaces adjoin at a seam.

* * * * *